US010622693B2

(12) United States Patent
Zhang et al.

(10) Patent No.: US 10,622,693 B2
(45) Date of Patent: Apr. 14, 2020

(54) FILTER UNIT AND FILTER

(71) Applicant: Huawei Technologies Co., Ltd., Shenzhen, Guangdong (CN)

(72) Inventors: Chuanan Zhang, Chengdu (CN); Yi Chen, Chengdu (CN)

(73) Assignee: HUAWEI TECHNOLOGIES CO., LTD., Shenzhen, Guangdong (CN)

( * ) Notice: Subject to any disclaimer, the term of this patent is extended or adjusted under 35 U.S.C. 154(b) by 38 days.

(21) Appl. No.: 15/980,646

(22) Filed: May 15, 2018

(65) Prior Publication Data

US 2018/0261901 A1 Sep. 13, 2018

Related U.S. Application Data

(63) Continuation of application No. PCT/CN2016/072804, filed on Jan. 29, 2016.

(51) Int. Cl.

| | |
|---|---|
| ***H01P 1/208*** | (2006.01) |
| ***H01P 3/12*** | (2006.01) |
| ***H01P 7/06*** | (2006.01) |
| ***H01P 3/08*** | (2006.01) |
| ***H01P 5/08*** | (2006.01) |

(52) U.S. Cl.

CPC ..... *H01P 1/2088* (2013.01); *H01P 3/081* (2013.01); *H01P 3/121* (2013.01); *H01P 5/08* (2013.01); *H01P 7/065* (2013.01)

(58) Field of Classification Search

CPC ..... H01P 3/121; H01P 1/2088; H01P 3/081
USPC ..... 333/202, 204, 208, 209
See application file for complete search history.

(56) References Cited

U.S. PATENT DOCUMENTS

| | | | |
|---|---|---|---|
| 8,309,925 | B2 | 11/2012 | Mendis et al. |
| 2004/0155732 | A1 | 8/2004 | Fukunaga |

FOREIGN PATENT DOCUMENTS

| | | | |
|---|---|---|---|
| CN | 1316674 | C | 5/2007 |
| CN | 102354790 | A | 2/2012 |
| CN | 105006613 | A | 10/2015 |
| CN | 105119032 | A | 12/2015 |
| EP | 1447876 | A1 | 8/2004 |
| KR | 101378477 | B1 | 3/2014 |
| WO | 2011138385 | A1 | 11/2011 |
| WO | 2014148708 | A1 | 9/2014 |

OTHER PUBLICATIONS

Xiangjun Zhang et al., "Design of compact dual-passband LTCC filter exploiting stacked QMSIW and EMSIW," Electronics Letters vol. 51 No. 12. Jun. 11, 2015. pp. 912-914. XP006052491.

*Primary Examiner* — Rakesh B Patel
(74) *Attorney, Agent, or Firm* — Womble Bond Dickinson (US) LLP

(57) ABSTRACT

A filter unit and a filter are disclosed. The filter unit includes two stacked cavities. Each cavity includes a dielectric substrate, and two surfaces of the dielectric substrate are each provided with a metal covering layer. Connected coupling slots and a row of metal slots parallel to the coupling slots are etched on a metal covering layer. One end of a coupling slot is an open end, and the other end is a closed end. The open end corresponds to a magnetic wall structure, and the closed end corresponds to an electric wall structure. The two cavities are coupled and connected by using the coupling slots.

11 Claims, 5 Drawing Sheets

FILTER UNIT AND FILTER

CROSS-REFERENCE TO RELATED APPLICATIONS

This application is a continuation of International Application No. PCT/CN2016/072804, filed on Jan. 29, 2016, which is hereby incorporated by reference in its entirety.

TECHNICAL FIELD

The present application relates to the field of communication technology, and in particular, to a filter unit and a filter.

BACKGROUND

A substrate integrated waveguide technology is an innovative waveguide structure. Such a technology has risen in recent years and can be integrated into a dielectric substrate. The innovative waveguide structure has advantages of using both a planar transmission line and a metal waveguide. This type of structure is irreplaceable in microwave circuit design. With maturity and development of the substrate integrated waveguide technology, microwave devices such as filters, power splitters, and antennas can be implemented by using substrate integrated waveguide structures. In communications systems, a filter has a special purpose, function, and is essential. Conventional substrate integrated waveguide filter can have a relatively large structural size, and occupy a large area on a microwave board, which goes against miniature system design and structure. Additionally, conventional substrate integrated waveguide filters can have relatively poor out-of-band suppression performance and a relatively close parasitic passband (away from a primary passband by 2f0).

A conventional miniature substrate integrated waveguide resonator can structurally include an upper PCB board, a lower PCB board, and several plated through-holes. A first copper clad layer, a second copper clad layer, a first dielectric layer, and several internal plated through-holes can define an upper resonator. A third copper clad layer, a fourth copper clad layer, a second dielectric layer, and several internal plated through-holes can define a lower resonator. Each resonator can define a triangle, and copper clad surfaces that can be stacked and in contact with each other. The two resonators can be etched with metal slots to couple and cascade the upper resonator and the lower resonator into one resonator. Metal slots obtained through etching along directions of plated through-holes can define a triangle. For this type of conventional waveguide resonator, a planar area of a resonator can be reduced, but the planar area still has not reached its minimum size, which can be further reduced. Such a conventional resonator can have a parasitic passband of a filter formed relatively close to a primary passband (at a distance of 3f0, where f0 is a center frequency of the primary passband), and if the filter is used in a microwave circuit, a system signal-to-noise ratio can be deteriorated.

Furthermore, such conventional substrate integrated waveguide use a Chebyshev filter. The filter can be a directly coupled triangular substrate integrated waveguide cavity filter, including isosceles triangular cavities. The isosceles triangular cavities can be sequentially arranged into a regular polygon. Any two neighboring isosceles triangular cavities can be, respectively, a start cavity and an end cavity. An input port and an output port can be, respectively, disposed on the start cavity and the end cavity. A coupling window can be disposed between the start cavity and a cavity neighboring to the start cavity. A coupling window can be disposed between the end cavity and a cavity neighboring to the end cavity. The coupling window can be disposed between neighboring cavities, and the neighboring cavities can be located between the start end cavity and the end cavity. The isosceles triangular cavities can be formed by plated through-holes provided on a dielectric substrate having both surfaces covered with a metal foil, and the plated through-holes can be arranged into an isosceles triangle. The use of such a conventional filter has an excessively large size in which aspects of an area and size are not improved. Such a conventional cavity filter also can have parasitic passband relatively close to a primary passband (at a distance of 2f0, where f0 is a center frequency of the primary passband), and out-of-band suppression can be insufficient. That is, such a conventional Chebyshev filter has a single magnetic coupling form used between filter units of the filter in which out-of-band suppression of the filter is not high.

SUMMARY

Examples and embodiments are disclosed providing a filter unit and filter to reduce volume of the filter unit, facilitate miniature development of the filter, and improve out-of-band suppression of the filter.

According to one embodiment, a filter unit includes two stacked cavities. Each cavity includes a dielectric substrate, a first metal covering layer and a second metal covering layer that are disposed on two opposite surfaces of the dielectric substrate. A row of first plated through-holes, a row of second plated through-holes, and a row of third plated through-holes are provided on the dielectric substrate, and a coupling slot is provided on the first metal covering layer. The first metal covering layer is in a shape of a right triangle. The row of first plated through-holes is parallel to a hypotenuse of the first metal covering layer, and the first plated through-hole runs through the first metal covering layer and the second metal covering layer. The row of second plated through-holes is located outside the first metal covering layer and is parallel to a cathetus of the first metal covering layer. The row of second plated through-holes runs through the second metal covering layer, and each of the row of second plated through-holes is connected to a metal sheet. A gap is between neighboring metal sheets, and the row of second plated through-holes and the metal sheets form a magnetic wall structure. The row of third plated through-holes is located outside the first metal covering layer and is parallel to the other cathetus of the first metal covering layer. The row of third plated through-holes runs through the second metal covering layer, and t forms an electric wall structure. The coupling slot is parallel to the row of first plated through-holes, and one end of the coupling slot facing the magnetic wall structure runs through the first metal covering layer, and one end of the coupling slot facing the electric wall structure is a closed end. Coupling slots between the two cavities are provided face to face, and the two cavities are coupled by using two coupling slots.

In the disclosed embodiments, two cavities are stacked to form a filter unit, and the two cavities can be coupled and connected by using coupling slots to form the filter unit. In this way, a feeding port need only be disposed on a hypotenuse of a cavity. For the disclosed embodiments, physical size of a filter can be effectively reduced as well as a planar area of the filter unit.

According to one embodiment, each cavity can further include two parallel metal slots provided on the first metal covering layer. The two metal slots can be separately and vertically connected to the coupling slot, and divide the coupling slot into two parts. Two metal slots can run through the row of first plated through-holes, and the row of first plated through-holes can be divided into two parts arranged outside the two metal slots A microstrip can be disposed between two metal slots of one of the cavities.

According to one embodiment, a coupling slot has a length L and a width W, and a ratio of the length L to the width W satisfies a condition that L/W falls in between one fourth wavelength and one wavelength, where the wavelength is an operating wavelength of the filter unit. For one embodiment, L/W is preferably equal to one half wavelength.

According to one embodiment, a coupling slot is provided on a side that departs from a hypotenuse and that is of a plated through-hole on a first copper clad layer of the triangular dielectric substrate, and a distance from the coupling slot to an edge plated through-hole is less than 0.5 mm. For one embodiment, the distance from the coupling slot to the edge plated through-hole can be 0.1 mm.

According to one embodiment, a row of plated through-holes parallel to each cathetus of the dielectric substrate is provided on a dielectric substrate, where one end of each of the row of plated through-holes runs through a metal covering layer of the dielectric substrate, and the other end corresponds to one metal sheet. The metal sheets and the plated through-holes form the magnetic wall structure, and each of another row of plated through-holes runs through the dielectric substrate. The plated through-holes can form the electric wall structure. For one embodiment, the metal sheet is a rectangular metal sheet, and a plated through-hole corresponding to the rectangular metal sheet is located at a central location of the rectangular metal sheet.

According to one embodiment, a filter includes filter units in which two of the filter units can be connected to microstrips. One microstrip can be used as an input line, the and other microstrip can be used as an output line. Two neighboring filter units can share a magnetic wall structure or an electric wall structure. For one embodiment, two filter units can be connected through magnetic coupling or electric coupling. For other embodiments, there are more than two filter units, the two or more filter units can be connected through alternate coupling of electric coupling and magnetic coupling. By way of alternate coupling of electric coupling and magnetic coupling, a parasitic passband can be suppressed. For the disclosed embodiments, compared with a conventional filter unit, an operating frequency in a higher order mode of the conventional filter unit at 2f0, while an operating frequency in a higher order mode of the filter unit of the disclosed embodiments is at 4f0. Therefore, a parasitic passband of a conventional filter occurs at 2f0, while a parasitic passband of the filter of the disclosed embodiments can occur at 4f0 (f0 is a center frequency of the filter), so as to suppress the parasitic passband.

According to one embodiment, for magnetic coupling, when the neighboring filter units share the magnetic wall structure, a slot whose cross section can be circular is provided on a metal covering layer located on a side opposite to the magnetic wall structure. Two neighboring filter units can be connected through magnetic coupling by using the slot. Moreover, when the slot is specifically set, the slot can have a diameter D and a slot width S, and D/S can be less than one tenth wavelength.

According to one embodiment, for electric coupling, when the neighboring filter units share the electric wall structure, a strip is provided on a metal covering layer located on a side opposite to the electric wall structure. Two neighboring filter units can be connected through electric coupling by using the strip.

BRIEF DESCRIPTION OF DRAWINGS

The appended drawings illustrate examples and are, therefore, exemplary embodiments and not considered to be limiting in scope.

DESCRIPTION OF EMBODIMENTS

Examples and embodiments of a filter unit are disclosed. Disclosed embodiments can provide improved out-of-band suppression characteristic while implementing a miniature filter. For one embodiment, a filter unit includes two stacked cavities. Each stacked cavity can include a dielectric substrate, a first metal covering layer and a second metal covering layer that are disposed on two opposite surfaces of the dielectric substrate. A row of first plated through-holes, a row of second plated through-holes, and a row of third plated through-holes are provided on the dielectric substrate, and a coupling slot is provided on the first metal covering layer. The first metal covering layer can be in a shape of a right triangle. The row of first plated through-holes can be parallel to a hypotenuse of the first metal covering layer, and the first plated through-hole can run through the first metal covering layer and the second metal covering layer. The row of second plated through-holes can be located outside the first metal covering layer and can be parallel to a cathetus of the first metal covering layer. The row of second plated through-holes can run through the second metal covering layer, and each row of second plated through-holes can be connected to a metal sheet. For one embodiment, there can be a gap between neighboring metal sheets, and the row of second plated through-holes and the metal sheets can form a magnetic wall structure. The row of third plated through-holes can be located outside the first metal covering layer and can be parallel to the other cathetus of the first metal covering layer. The row of third plated through-holes can run through the second metal covering layer, and the row of third plated through-holes can form an electric wall structure. The coupling slot can be parallel to the row of first plated through-holes, and one end of the coupling slot facing the magnetic wall structure can run through the first metal covering layer, and one end of the coupling slot facing the electric wall structure is a closed end. Coupling slots between the two cavities can be provided face to face, and the two cavities can be coupled by using two coupling slots.

According to one embodiment, two cavities can be stacked to form a filter unit. The two cavities can be coupled and connected by using coupling slots to form the filter unit. In this way, only a feeding port needs to be provided on a hypotenuse of a cavity, a physical size and planar area of a filter can be reduced. The filter unit described herein includes two cavities such as a first cavity and a second cavity. The first cavity and second cavity can be coupled and connected by using a coupling slot. For one embodiment, a metal covering layer for the filter unit may include copper.

Figure 1:
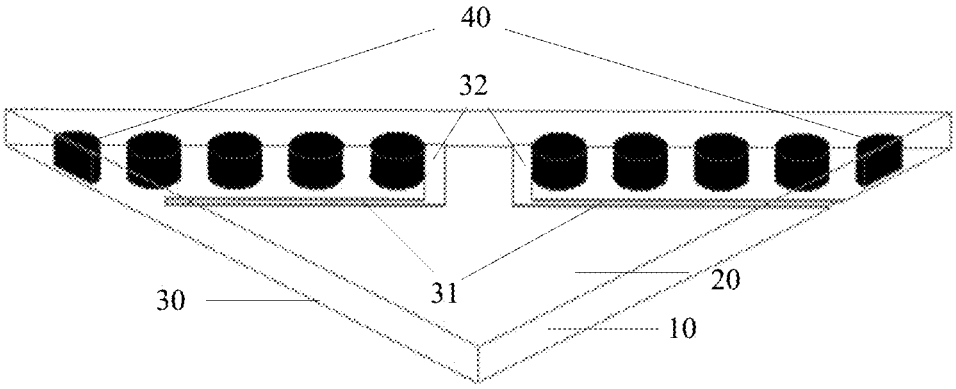
FIG. 1 is a schematic structural diagram of a first cavity according to one embodiment.
Figure 2:
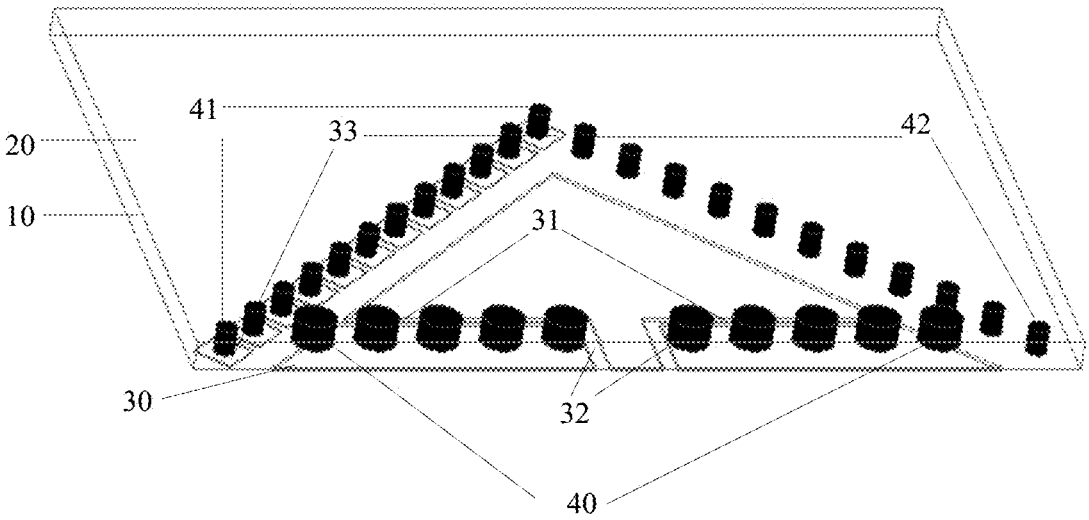
FIG. 2 is a schematic structural diagram of a first cavity according to one embodiment.

FIG. 1 is a schematic structural diagram of a first cavity according to one embodiment. The first cavity includes a first dielectric substrate 10, and two opposite surfaces of the first dielectric substrate 10 are respectively provided with a first metal covering layer 20 and a second metal covering layer 30. For one embodiment, the first metal covering layer 20 is in a shape of a right triangle, and the shape of the second metal covering layer 30 can be any shape and not limited to a particular shape. The first metal covering layer 20 can provided with first plated through-holes 40 parallel to a hypotenuse of the triangle of the first metal covering layer 20. The first plated through-holes 40 can run through the first metal covering layer 20 and the second metal covering layer 30. Referring to FIG. 2, a row of second plated through-holes 41 located outside the first metal covering layer 20 and parallel to one cathetus of the first metal covering layer 20 is provided on the first dielectric substrate 10. For one embodiment, the first plated through-holes 40 do not run through the first metal covering layer 20. For one embodiment, the second plated through-hole 41 runs through the first dielectric substrate 10 and the second metal covering layer 30, and connected to one metal sheet 33. A gap between neighboring metal sheets 33 is provided. The metal sheets 33 and the second plated through-holes 41 can form a magnetic wall structure. The first dielectric substrate 10 is further provided with a row of third plated through-holes 42 located outside the first metal covering layer 20 and parallel to the other hypotenuse of a triangle formed by the first metal covering layer 20. The third plated through-holes 42 run through the first dielectric substrate 10, and can form an electric wall structure.

For example, FIG. 2 shows a structure of a first cavity having a magnetic wall structure and an electric wall structure. In this embodiment, second plated through-holes 41 and third plated through-holes 43 are located outside a first metal covering layer 20. That is, in one embodiment, none of the second plated through-holes 41 and the third plated through-holes 43 run through the first metal covering layer 20. For one embodiment, the second plated through-holes A 41 and the third plated through-holes 43 all run through a first dielectric substrate 10 and a second metal covering layer 30. When the magnetic wall structure is formed, the second plated through-holes 41 can be connected to metal sheets 33, a row of second plated through-holes 41. The row of metal sheets 33 can form a magnetic wall structure, and the metal sheets 33 can be disposed on the second metal covering layer 30. For one embodiment, metal sheets 33 can be rectangular metal sheets having a plated through-hole at a central location of the rectangular metal sheets. For one embodiment, when an electric wall structure is formed, a row of formed third plated through-holes 43 is used, and the row of third plated through-holes 43 can form the electric wall structure.

According to one embodiment, the first cavity can be provided with coupling slots 31 on the first metal covering layer 20. For example, the coupling slots 31 are parallel to a row of first plated through-holes 40. Referring to FIG. 1, the coupling slots 31 are disposed on a side that departs from a hypotenuse of a triangle of the second covering layer 20 of the first plated through-hole 40, and a distance from the coupling slot 31 to an edge first plated through-hole A 40 is less than 0.5 mm. For example, the distance may be 0.5 mm, 0.4 mm, 0.3 mm, 0.25 mm, 0.2 mm, 0.15 mm, 0.1 mm, 0.05 mm, or another distance. For one embodiment, the distance from the coupling slot 31 to the edge first plated through-hole 40 is 0.1 mm.

For one embodiment, the coupling slot 31 has a length L and a width W, and a ratio of the length L to the width W, which satisfies a condition that L/W falls in between one fourth (¼) wavelength and one (1) wavelength, where the wavelength is an operating wavelength of the filter unit. For example, a ratio of L/W can be one fourth (¼), one third (⅓), one half (½), two third (⅔), one (1), or the like, so that when being coupled, the first cavity and a second cavity can have a good coupling effect. For one embodiment, L/W is preferably equal to one half (½) wavelength. Therefore, the first cavity and the second cavity can have a good coupling effect.

Referring to FIG. 1, one end of the coupling slot 31 facing the magnetic wall structure can run through the first metal covering layer 20 to form an open end. For one embodiment, a side facing the electric wall structure does not run through the first metal covering layer 20 to form a closed end. In this embodiment, a function of run-through or non-run-through of the coupling slot 31 can affect electromagnetic field distribution inside the filter unit. As such, the size of filter unit of the disclosed embodiments can be greatly reduced with different electromagnetic field structures. For example, a filter unit can have end portions of coupling slots on two cathetuses of the filter unit, which are not the same forming different electromagnetic field structures. For the coupling slot runs through example, electric field can be distributed parallel to a cathetus in which strength of the electric field can be weaker than the strength of a magnetic field. As a result, the cathetus can be characterized by a magnetic wall. For the coupling slot does not run through example, electric field can be distributed perpendicular to a cathetus in which strength of the electric field can be stronger than strength of a magnetic field. As a result, the cathetus can be characterized by an electric wall. Characteristics of the formed electric wall and the magnetic wall can enable the size of the filter unit to be greatly reduced without changing an operating frequency.

According to one embodiment, the first cavity includes two parallel metal slots 32 provided on the first metal covering layer 20. The two metal slots 32 can be separately vertically connected to the coupling slot 31, and divide the coupling slot 31 into two parts. For one embodiment, the two metal slots 32 can run through the row of first plated through-holes, and the row of first plated through-holes can be divided into two parts arranged outside the two metal slots 32. A microstrip can be disposed between two metal slots 32 of one of the cavities. As shown in FIG. 1, the two metal slots 32 run through first plated through-holes 40 and cut off a row of first plated through-holes 40 in which there is no plated through-hole between the two metal slots 32.

Figure 3:
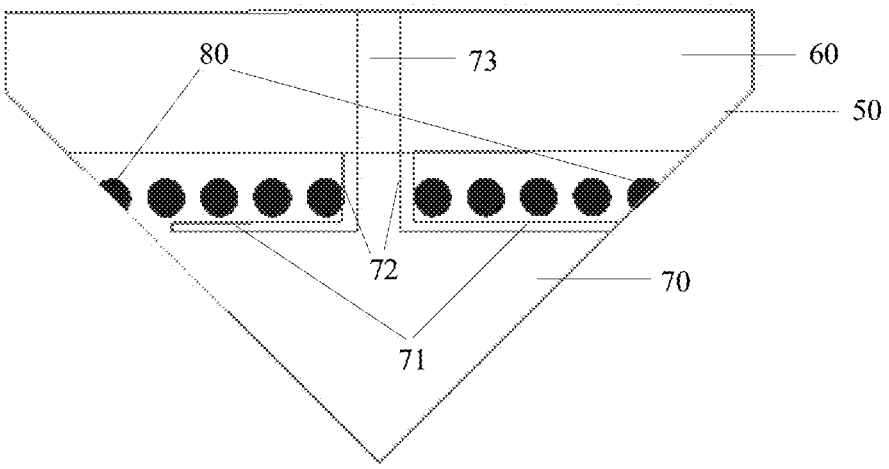
FIG. 3 is a schematic structural diagram of a second cavity of a filter unit according to one embodiment.
Figure 4:
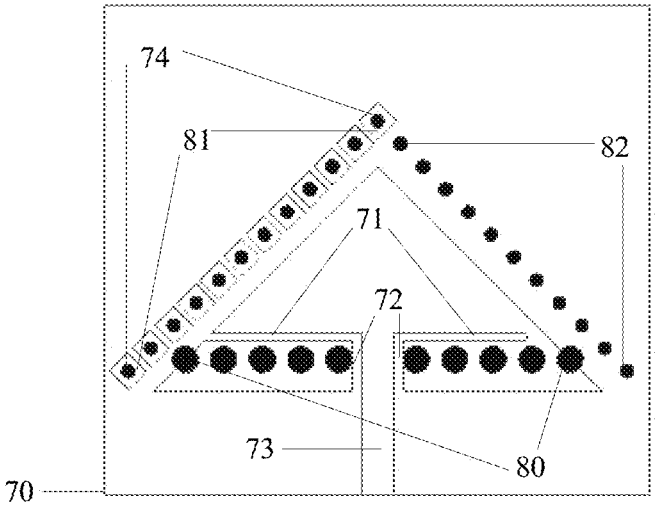
FIG. 4 is a schematic structural diagram of a second cavity of a filter unit according to one embodiment.

FIGS. 3 and 4 show separately schematic structural diagrams of second cavities of different structures according to one embodiment. Referring to FIGS. 3 and 4, a structure of a second cavity can be similar to a structure of a first cavity in which difference involves a microstrip 73 connected between two metal slots of the second cavity. Microstrip 73 can be used as an input end or an output end. For one embodiment, as shown in FIG. 4, microstrip 73 can be connected to a metal slot 72.

As shown in FIGS. 3 and 4, in the second cavity, second dielectric substrate 50 is a dielectric substrate. Two layer metal covering layers located on the second dielectric substrate 50 are, respectively, shown as first metal covering layer 60 and a second metal covering layer 70. A row of plated through-holes located at a hypotenuse is shown as first plated through-holes 80. Two row of plated through-holes located at cathetuses are, respectively, shown as second plated through-holes 81 and third plated through-holes 82. For one embodiment, structures and functions of a coupling slot 71, the metal slot 72, and a metal sheet 74 of the second cavity can be the same as those of a coupling slot 31, a metal slot 32, and a metal sheet 33 of the first cavity. The first metal covering layer 60 of the second cavity can be the same as a first metal covering layer 20 of the first cavity. The second metal covering layer 70 can be the same as a second metal covering layer 30. The first plated through-hole 80 and a first plated through-hole 40 can be provided in a same manner. The second plated through-hole 81 and a second plated through-hole 41 can have a same structure and provided in a same manner. The third plated through-hole 82 and a third plated through-hole 43 can have a same structure and provided in a same manner.

For one embodiment, when a filter unit is formed, the first cavity and the second cavity can be stacked, and the coupling slot of the first cavity and the coupling slot of the second cavity can be provided opposite to each other to form a coupling structure. For example, a first copper clad layer of the first cavity can come into contact with a fourth copper clad layer of a third cavity and complete assembly of the filter unit.

Figure 5:
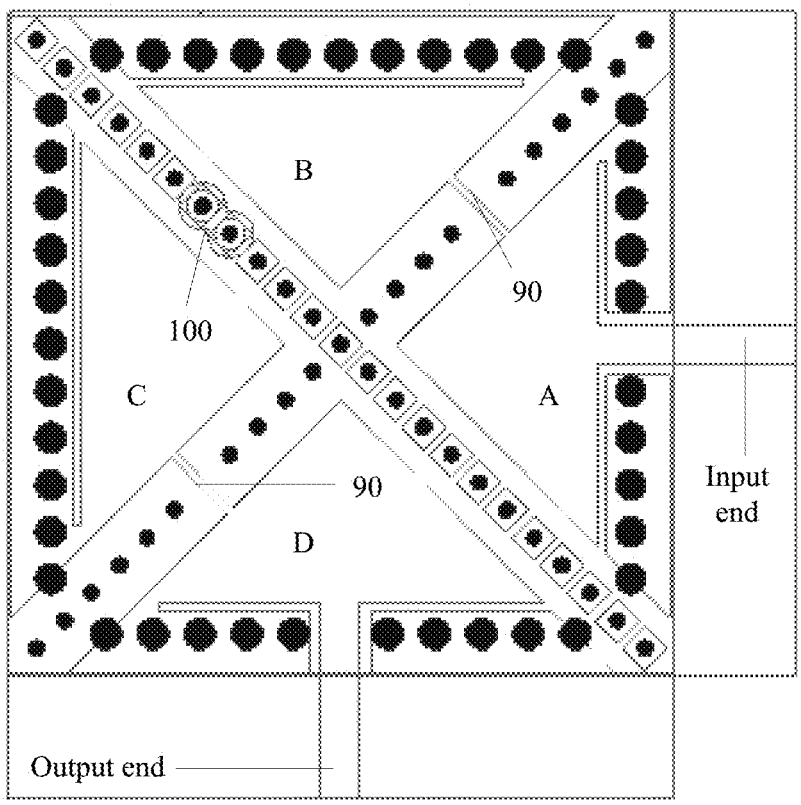
FIG. 5 is a schematic structural diagram of a filter according to one embodiment.

As shown in FIG. 5, according to one embodiment, a filter can include a plurality of filter units. For one example, two of the filter units can be connected to microstrips. For one embodiment, one microstrip can be used as an input line and the other microstrip can be used as an output line. Two neighboring filter units can share a magnetic wall structure or an electric wall structure. For one embodiment, when there are two filter units, the two filter units can connected through magnetic coupling or electric coupling. For another embodiment, when there are more than two filter units, the filter units can be connected through alternate coupling of electric coupling and magnetic coupling.

Figure 6:
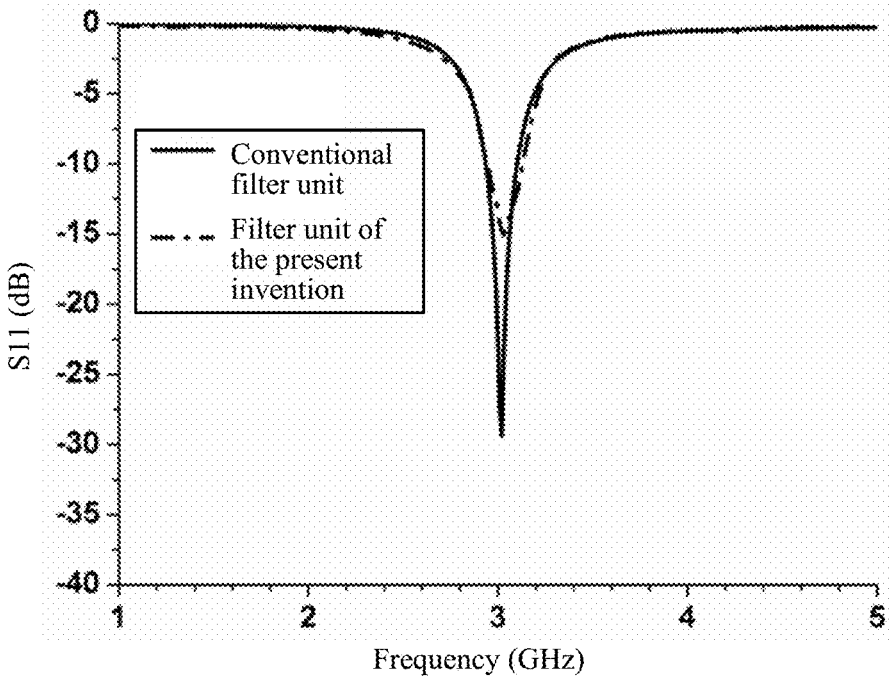
FIG. 6 is a chart of comparison between a filter provided in one embodiment.

According to one embodiment, by way of electric coupling or magnetic coupling, a parasitic passband can be suppressed. For example, as shown in FIG. 6, compared with a conventional filter having an operating frequency in a higher order mode at 2f0, an operating frequency in a higher order mode of the disclosed filter units is at 4f0. As such, a parasitic passband of a conventional filter occurs at 2f0, while a parasitic passband of the disclosed filters can occur at or near 4f0 (f0 is a center frequency of the filter) in suppressing the parasitic passband.

Figure 7A:
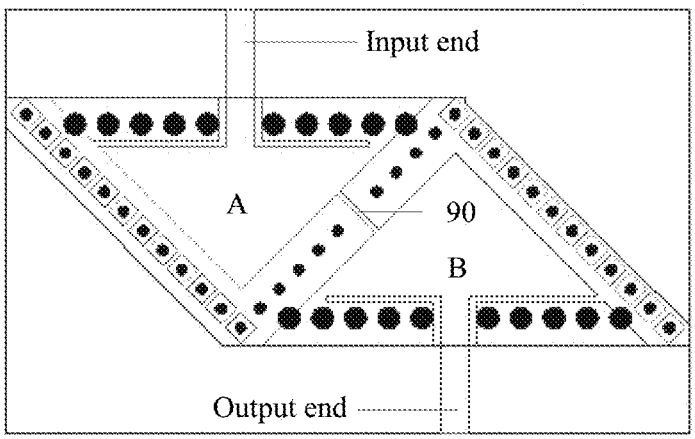
FIG. 7*a* to FIG. 7*d* are schematic structural diagrams of a filter using two filter units according to one embodiment.
Figure 7B:
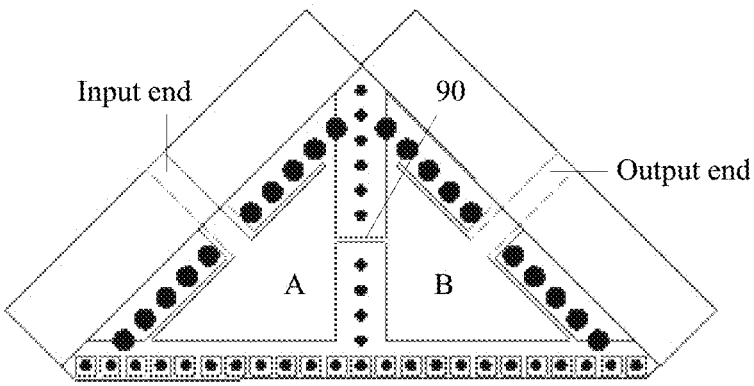
Figure 7C:
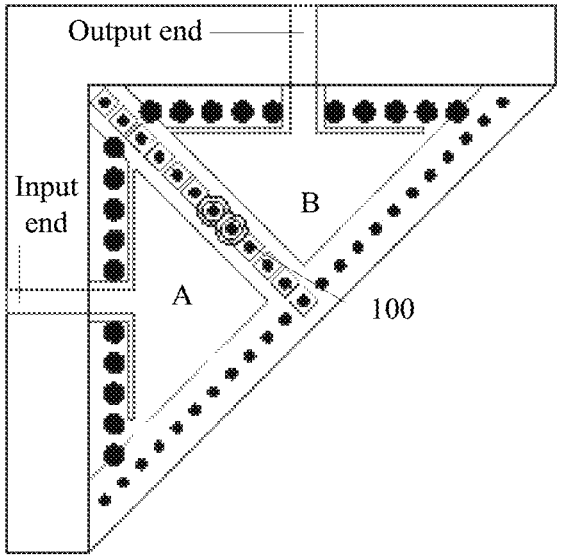
Figure 7D:
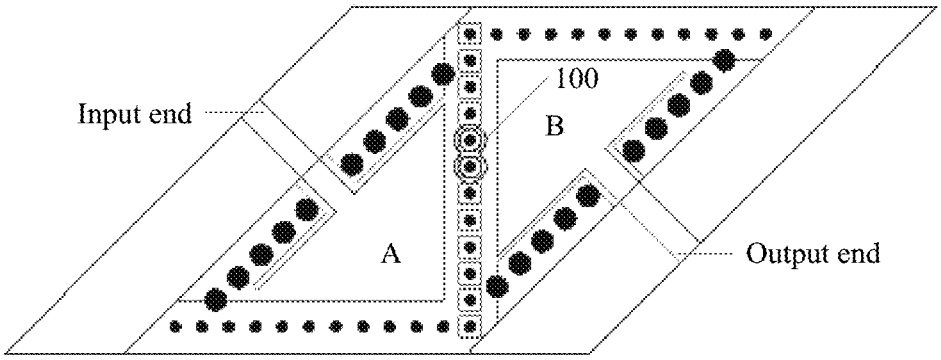

For one embodiment, the number of filter units in the filter is at least two. When two filter units are used, for one embodiment, the two filter units can be, respectively, a filter unit A and a filter unit B as shown in FIGS. 7*a*-7*b*. In the examples of FIGS. 7*a*-7*b*, two filter units can share an electric wall structure, and the two filter units can be electrically coupled by using a strip. FIGS. 7*c* and 7*d* show that two filter units sharing a magnetic wall structure and coupled by using a slot.

For one embodiment, using magnetic coupling, neighboring filter units can share a magnetic wall structure, and a slot 100 whose cross section is circular can be provided on a metal covering layer located on a side opposite to the magnetic wall structure. The two neighboring filter units can be connected through magnetic coupling by using the slot 100. Moreover, when the slot 100 is specifically set, the slot 100 can have a diameter D and a slot width S, and D/S can be less than one tenth wavelength.

For one embodiment, using electric coupling, neighboring filter units can share an electric wall structure, and a strip 90 can be provided on a metal covering layer located on a side opposite to the electric wall structure. The two neighboring filter units can be connected through electric coupling by using the strip 90.

As shown in FIG. 5, letters A, B, C, and D represent four filter units. A filter unit A and a filter unit D are respectively connected to a microstrip 73 at an input end and a microstrip 73 at an output end. The filter unit A and the filter unit B can be cascaded in an electric coupling manner by using a strip 90, and the filter unit C and the filter unit D can be cascaded in an electric coupling manner by using a strip 90. The filter unit B and the filter unit C can be cascaded in a magnetic coupling manner by using circular coupling slots 100. The circular coupling slots 100 in magnetic coupling can be symmetrically distributed at a second metal covering layer and a fourth metal covering layer, and can be located at a middle location of a magnetic wall of the filter units. The strips 90 in electric coupling can be located at a first metal covering layer and a third metal covering layer, and the strips 90 in electric coupling can be connected to the metal covering layers.

Referring to FIG. 6, comparison with a conventional filter unit, an operating frequency in a higher order mode of the conventional filter unit is at 2f0, while an operating frequency in a higher order mode of the disclosed filter units can be at 4f0. Therefore, a parasitic passband of a conventional filter occurs at 2f0, while a parasitic passband of the filter units disclosed can occur near or at 4f0 (f0 is a center frequency of the filter), so as to suppress the parasitic passband.

In the foregoing specification, embodiments of invention have been described with reference to specific examples thereof. It will, however, be evident that various modifications and changes may be made thereto without departing from the broader spirit and scope of disclosed examples and embodiments. The specification and drawings are, accordingly, to be regarded in an illustrative rather than a restrictive sense.

What is claimed is:

1. A filter unit comprising:

at least two stacked cavities, each cavity comprises a dielectric substrate, a first metal covering layer and a second metal covering layer that are disposed on two opposite surfaces of the dielectric substrate, a row of first plated through-holes, a row of second plated through-holes, and a row of third plated through-holes that are provided on the dielectric substrate, and a coupling slot provided on the first metal covering layer, wherein, for a first of the at least two stacked cavities, the first metal covering layer is in a shape of a right triangle, the row of first plated through-holes is parallel to a hypotenuse of the first metal covering layer, and the row of first plated through-holes runs through the first metal covering layer and the second metal covering layer, the row of second plated through-holes is located outside the first metal covering layer and is parallel to a cathetus of the first metal covering layer, the row of second plated through-holes runs through the second metal covering layer, each of the row of second plated through-holes is connected to a corresponding metal sheet, there is a gap between neighboring metal sheets, and the row of second plated through-holes and the metal sheets form a magnetic wall structure, the row of third plated through-holes is located outside the first metal covering layer and is parallel to the other cathetus of the first metal covering layer, the row of third plated through-holes runs through the second metal covering layer, and the row of third plated through-holes forms an electric wall structure, the coupling slot provided on the first metal covering layer is parallel to the row of first plated through-holes, and one end of the coupling slot facing the magnetic wall structure runs through the first metal covering layer, and one end of the coupling slot facing the electric wall structure is a closed end, and wherein the coupling slot and a second coupling slot of a second of the at least two stacked cavities are provided face to face, and the at least two cavities are coupled by using the two coupling slots.

2. The filter unit according to claim 1, wherein each cavity further comprises two parallel metal slots provided on the first metal covering layer, the two metal slots are separately vertically connected to the coupling slot, and divide the coupling slot into two parts, the two metal slots run through the row of first plated through-holes, and the row of first plated through-holes is divided into two parts arranged outside the two metal slots, and a microstrip is disposed between two metal slots of one of the cavities.

3. The filter unit according to claim 1, wherein the coupling slot has a length L and a width W such L/W falls in between one fourth wavelength and one wavelength.

4. The filter unit according to claim 3, wherein L/W is equal to one half wavelength.

5. The filter unit according to claim 1, wherein a distance from the coupling slot to an edge plated through-hole of the row of first plated through-holes is less than 0.5 mm.

6. The filter unit according to claim 5, wherein the distance from the coupling slot to the edge plated through-hole of the row of first plated through-holes is 0.1 mm.

7. The filter unit according to claim 6, wherein each of the metal sheets is a rectangular metal sheet, and each of the second plated through-holes corresponding to the rectangular metal sheets is located at a central location of the corresponding rectangular metal sheet.

8. A filter, comprising at least two filter units according to claim 1, wherein two of the filter units are connected to a first microstrip and a second microstrip, the first microstrip is used as an input line, the second microstrip is used as an output line, and two neighboring filter units share the magnetic wall structure or the electric wall structure, and when a quantity of the filter units is two, the two filter units are connected through magnetic coupling or electric coupling, or when a quantity of the filter units is more than two, the more than two filter units are connected through an alternate coupling of electric coupling and magnetic coupling.

9. The filter according to claim 8, wherein when the neighboring filter units share the magnetic wall structure, a slot whose cross section is circular is provided on a metal covering layer located on a side opposite to the magnetic wall structure, and the two neighboring filter units are connected through the magnetic coupling by using the slot.

10. The filter according to claim 9, wherein the slot has a diameter D and a slot width S, and D/S is less than one tenth wavelength.

11. The filter according to claim 8, wherein when the neighboring filter units share the electric wall structure, a strip is provided on a metal covering layer located on a side opposite to the electric wall structure, and the two neighboring filter units are connected through the electric coupling by using the strip.

* * * * *